US009097489B2

(12) United States Patent
Chiang

(10) Patent No.: US 9,097,489 B2
(45) Date of Patent: Aug. 4, 2015

(54) GUN MAGAZINE POUCH

(71) Applicant: Charlie W. Chiang, Anaheim, CA (US)

(72) Inventor: Charlie W. Chiang, Anaheim, CA (US)

( * ) Notice: Subject to any disclaimer, the term of this patent is extended or adjusted under 35 U.S.C. 154(b) by 0 days.

(21) Appl. No.: 14/061,194

(22) Filed: Oct. 23, 2013

(65) Prior Publication Data

US 2014/0109455 A1 Apr. 24, 2014

Related U.S. Application Data

(60) Provisional application No. 61/717,774, filed on Oct. 24, 2012.

(51) Int. Cl.

| | |
|---|---|
| ***F41C 27/00*** | (2006.01) |
| ***F42B 39/02*** | (2006.01) |
| *F42B 39/26* | (2006.01) |

(52) U.S. Cl.

CPC ..... *F41C 27/00* (2013.01); *F42B 39/02* (2013.01); *F42B 39/26* (2013.01); *Y10S 224/931* (2013.01)

(58) Field of Classification Search

USPC ..... 224/239, 242, 245, 931, 901.2, 901.4, 224/901.6; D3/262

See application file for complete search history.

(56) References Cited

U.S. PATENT DOCUMENTS

| | | | | |
|---|---|---|---|---|
| 666,687 | A * | 1/1901 | Orndorff | 139/390 |
| 1,756,677 | A * | 4/1930 | Cook | 224/245 |
| 5,152,442 | A * | 10/1992 | Gallagher | 224/245 |
| 6,026,873 | A * | 2/2000 | Van Geer | 150/147 |
| 6,491,194 | B2 * | 12/2002 | Marvin | 224/483 |
| 6,874,618 | B1 * | 4/2005 | Cragg | 206/3 |
| 7,918,371 | B2 * | 4/2011 | Wilson | 224/196 |
| 8,104,656 | B1 * | 1/2012 | George | 224/674 |
| 8,322,065 | B2 * | 12/2012 | Faifer | 42/90 |
| 8,733,606 | B2 * | 5/2014 | Felts | 224/671 |
| 2013/0082080 | A1 * | 4/2013 | Hellweg | 224/672 |
| 2013/0098935 | A1 * | 4/2013 | Sheffield | 221/1 |

* cited by examiner

*Primary Examiner* — Justin Larson

(57) ABSTRACT

A magazine holder for use with a gun includes a cavity configured to receive at least two magazines and a biasing member in the cavity and configured to engage at least one magazine located in the cavity to maintain the at least one magazine in the cavity.

21 Claims, 7 Drawing Sheets

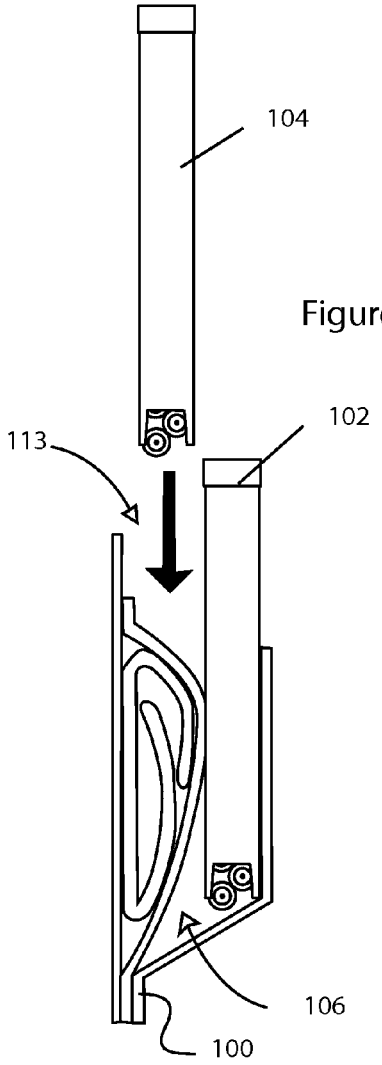
Figure 4
Figure 5
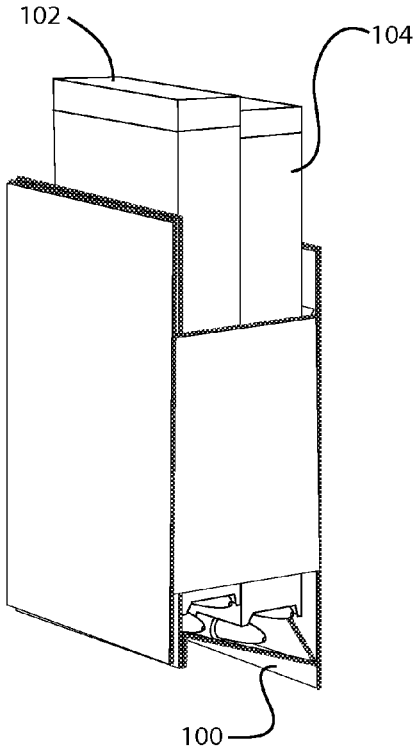

GUN MAGAZINE POUCH

RELATED APPLICATION

The present application claims the benefit of the filing date of U.S. Provisional Patent Application Ser. No. 61/717,774, filed Oct. 24, 2012, the disclosure of which is incorporated herein by reference.

FIELD

The present application generally relates to gun accessories, and more particularly, to a gun magazine pouch.

BACKGROUND

Double magazine pouches are typically used by military personnel, SWAT teams, Federal Agents and others (hereinafter referred to as "operators") who may need two or more magazines readily and rapidly available for use. One of the current problems with double stack magazine pouches is that it may be difficult to re-insert magazines into the pouch after the magazine is pulled out. The reasons for such possible difficulty in magazine reinsertion may be: (1) the pouch is not designed with the shape that closely resembles the shape of the magazine and is constructed with excess fabric; (2) when one magazine is removed from a double stack pouch, the other magazine is not secured in the pouch and flops around and also gets in the way of another magazine being inserted; (3) after one magazine is removed from the pouch, the excess space in the pouch may cause the second magazine to fallout during movement (e.g. take downs, climbing, get up and down on the ground behind cover, etc.). Thus, re-inserting a magazine in the currently available magazine pouches is time consuming. In particular, the operator may be required to use both hands to insert the magazine into the pouch. To overcome these deficiencies, a dump pouch may be used which is a large bag that attaches to an operator's belt into which magazines can be dumped. However, dump pouches also mean additional time during magazine exchanges because the pouch is usually mounted toward the back of an operator's belt. The additional time required for the operator to reach behind to access the pouch may hinder the operator's performance. The other problem with current pouch designs is that they do not account for other gear placed on body armor. One problem is that available space on body armor is limited and the operator may need to carry a large number of equipment (for example, grenade mags, radio, flares, etc). The other problem that operators face with current pouch designs is magazine management. Empty magazines are placed behind full ones when being re-inserted into the pouch. Due to the pouch's dimensions and problems mentioned above, reinserting magazines into the pouch becomes difficult. The other problem for operators is that when they need to pull a new magazine they have to look down to find the correct magazine to pull. This forces them to look down, taking their eyes off their surroundings, which increases the danger since they are no longer watching the enemy. Operators train countless hours to refine skills to avoid situations where they have to take their eyes off their environment. However, current double stack magazine pouches require the operators to look at the pouch to pull a magazine. Another problem with current pouches is the flap used to close the pouch. The flap typically opens from the front of the pouch (i.e., the side of the pouch that is farther from the operator) to allow access to the interior of the pouch. The problem with this design is that the flap gets in the way when re-inserting magazines into the pouch. Other variations of the flap have the flap open from the rear of the magazine so that the flap hangs in front of the pouch, and out of the way when re-inserting magazines. But the problem is that currently issued pouches and the vast majority of magazine pouches have flaps that open from the front. This creates muscle memory through training. If a magazine only opens from the rear, in the heat of battle, the operator may inadvertently try to lift the flap from the front, which is how they were trained.

BRIEF DESCRIPTION OF THE DRAWINGS

FIG. 4 shows the magazine pouch of FIG. 2 with a second magazine being inserted therein.

FIG. 5 is a side perspective view of the magazine pouch of FIG. 4 with the second magazine having been inserted therein.

DETAILED DESCRIPTION

Figure 1:
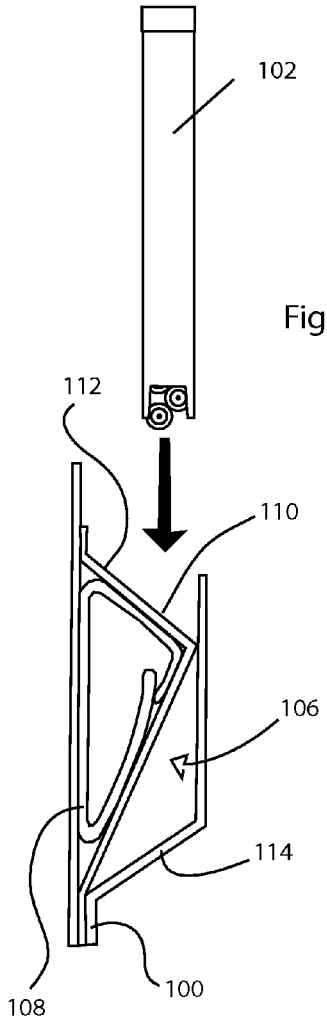
FIG. 1 shows a magazine pouch according to one embodiment with a magazine being inserted therein.
Figure 2:
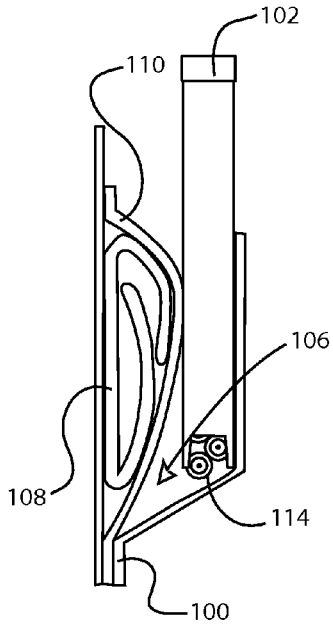
FIG. 2 shows the magazine pouch of FIG. 1 with the magazine having been inserted therein.
Figure 3:
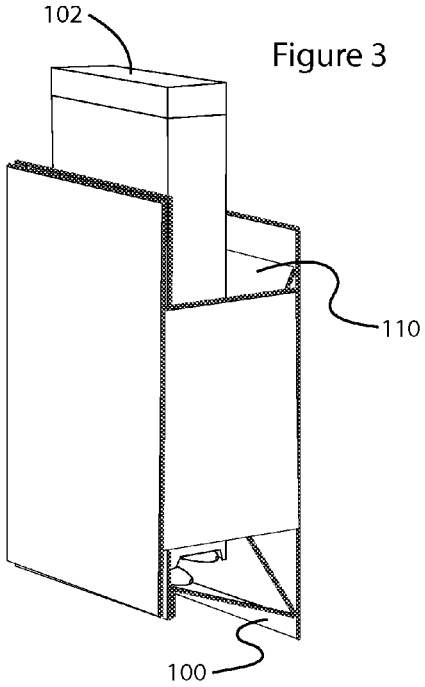
FIG. 3 is a side perspective view of the magazine pouch of FIG. 2.

Referring to FIGS. 1-14, a magazine holder or pouch 100 according to one example is shown. The magazine pouch 100 is shaped to receive at least two magazines for storage in an interior cavity 106. The magazines are shown in FIGS. 1-5 as a first magazine 102 and a second magazine 104. The interior cavity 106 includes a magazine holding mechanism by which one and/or both magazines are held in the interior cavity 106. The magazine holding mechanism may include a biasing member 108 that applies force on the first magazine 102 and/or the second magazine 104. The magazine holding mechanism including the biasing member 108 may be located at any location in the cavity 106. The magazine holding mechanism including the biasing member 108 may also be located outside the cavity 106 and apply force on at least one magazine inside the cavity 106. The biasing member 108 or any biasing member according to the disclosure may be a spring, an elastomer, elastic foam, or any object that when compressed provides an elastic restoring force opposite to the compressive force. The biasing mechanism may have a cover 110 for the biasing member 108. The cover prevents contact between the biasing member 108 and the magazines 102 or 104 because such contact may hinder insertion of the magazines into and removal of the magazines out of the interior cavity 106. For example if the biasing member 108 is constructed from spring steel, the frictional contact between the biasing member 108 and a magazine may hinder insertion and removal of the magazine and possibly damage the magazine and or the biasing member 108. The biasing mechanism may have a certain shape to assist in insertion of a magazine into the interior cavity 106. As shown in FIG. 1, the biasing mechanism may include an inclined surface 112 which is inclined in the direction of insertion of a magazine. Accordingly, pressing a magazine toward the interior cavity 106 and on the inclined surface 112 assists in compressing the biasing member 108.

The biasing member 108 exerts a compressive force on the magazines to maintain the magazines in the pouch 100. Accordingly, the pouch 100 may not require a cover for preventing the magazines from falling out of the pouch 100. However, the pouch 100 may include a cover (an example shown in FIGS. 12-14) that can be placed over one or more magazines that are inside the interior cavity 106. Furthermore, when one of the magazines is removed from the pouch 100, the biasing member 108 exerts pressure or compressive force on the remaining magazine to prevent the remaining magazine from falling out of the pouch 100 and further preventing the remaining magazine from freely moving within the pouch (e.g., flopping around). Additionally, when one magazine is removed from the pouch 100, the biasing force of the biasing member 108 moves the remaining magazine in the pouch 100, thereby creating an opening 113 (shown in FIG. 4) between the remaining magazine and the back wall of the pouch 100. The opening 113 allows an operator to insert another magazine into the pouch through the opening 113 without possibly looking at the pouch. Also, the biasing member 108 moving the magazine in the pouch 100 positions the magazine for easier identification and grabbing by the operator.

An operator may reach for a magazine stored in the pouch 100 without looking at the pouch 100. To assist the operator in selecting and grabbing only one magazine or a preferred magazine, the pouch 100 is shaped such that the first magazine 102 is positioned at a different vertical location than the second magazine 104 to allow the operator to identify the magazines without looking at the pouch 100. The pouch 100 includes an inclined bottom 114 which is upwardly inclined from the back (i.e., near the operator) of the pouch 100 towards the front of the pouch 100. However, the bottom 114 may be inclined in any direction. As shown in FIG. 5, the inclined bottom 114 causes the first magazine 102 to be positioned above the second magazine 104 when both magazines are stored in the pouch 100. Accordingly, an operator reaching for the magazines without looking at the magazines can identify the first magazine 102 and the second magazine 104 by touching the magazines.

Figure 6:
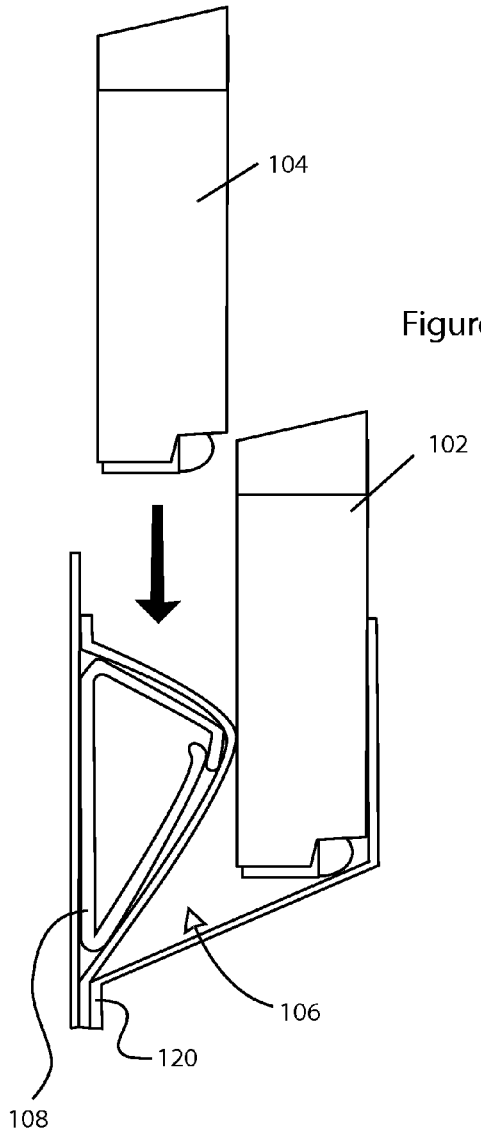
FIG. 6 shows a magazine pouch according to one embodiment configured to receive one or two magazines in a different orientation than the pouch of FIG. 1.

A pouch may be constructed so that the magazines that are to be placed in the pouch are oriented in a different direction than the direction of the magazines shown in the pouch of FIG. 1 in order to better suit the caliber of ammunition, properly position the pouch on an operator's body, and/or account for other obstacles, such as other pouches, equipment, and/or body parts of the operator. When using the pouch of FIG. 5, the sides of each of the magazines, which are generally in the same direction as the length of the rounds in the magazine, are pressed and moved by the biasing member 108 as described in detail above. FIG. 6 shows a pouch 120 according to another embodiment, where parts that are similar to the parts of the pouch 100 are referred to with the same reference numbers. When using the pouch 120, the front and back of each of the magazines, which are generally in the same direction as the width of the rounds in the magazine, are compressed and moved by the biasing member. The width of the pouch 120 is smaller than the width of the pouch 100, and therefore, the pouch 120 has a lower profile than the pouch 100.

According to one example, the interior cavity 106 may be partially or fully coated with a rubber and/or other types of smooth or textured frictional coatings to increase friction between the magazines and any part of the pouch according to the disclosure. Such a coating may be necessary when unusually large, unusually light, and heavy and/or oddly shaped magazines are used with a pouch. According to other examples, the interior cavity 106 may be formed or coated with a different material than the material of the pouch to provide a preferred frictional property between the magazines being inserted in the pouch 100 and interior cavity 106 of the pouch 100. A frictional coating that is partially or fully applied to the interior cavity 106 may be selected based on the material of construction of one or more magazines and/or the surface properties of the one or more magazines to provide sufficient friction between the coating and the one or more magazines.

The magazine holding mechanism may be an integral part of any of the pouches according to the examples described herein. In another example, as described in detail below, the magazine holding mechanism or any part thereof may be a separate piece that can be removed to provide a lower profile to the size of the pouch for operators conducting missions in tight confines or operators who need to reduce as much gear weight as possible. Furthermore, the holding mechanism or any part thereof may be removable so as to be replaceable with another holding mechanism or holding mechanism part. For example, a biasing member 108 may be removed and replaced with a stiffer biasing member 108. According to another embodiment, the magazine holding mechanism can be removed to be used in other pouches.

Figure 7:
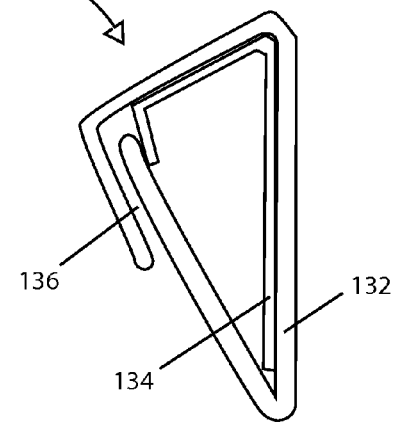
FIG. 7 shows a removable biasing mechanism for use with a magazine pouch according to one embodiment.

FIG. 7 shows an example of a magazine holding mechanism 130. The magazine holding mechanism 130 may include a housing 132 and a biasing member 134, which may be similar to the biasing member 108. Alternatively, the magazine holding mechanism may only include a biasing member 134. The housing 132 can be removably attached or connected to an interior cavity of a magazine pouch with snaps, buttons, Velcro, hooks and/or other types of fasteners. The housing 132 can also function as a cover for the biasing member 134 such as the cover 112 described above. The housing 132 may be constructed from fabric and have one or more fasteners, such as a hook and loop fastener 136 (e.g., Velcro®), to secure the biasing member 134 therein. The housing 132 may be wrapped around the biasing member 134. The fastener 136 then maintains the biasing member 134 inside the housing 132. The holding mechanism 130 can then be inserted into a typical magazine pouch to apply pressure on one or more magazines that may be placed in the pouch as described in detail herein.

FIGS. 8-11 show a pouch 300 having an adjustment mechanism according to one embodiment. The pouch 300 may be the same pouch as the pouch 100 or be similar in many respects to the pouch 100. To allow an operator to resize the cavity 106 to either adapt the pouch 300 for a certain type of magazine or to resize the cavity for single magazine operation, the pouch 300 may be constructed with an adjustment system. The adjustment system may also enhance the ability of the biasing member to push the magazine forward into the correct position and to assist the biasing member to hold onto a single magazine.

Figure 8:
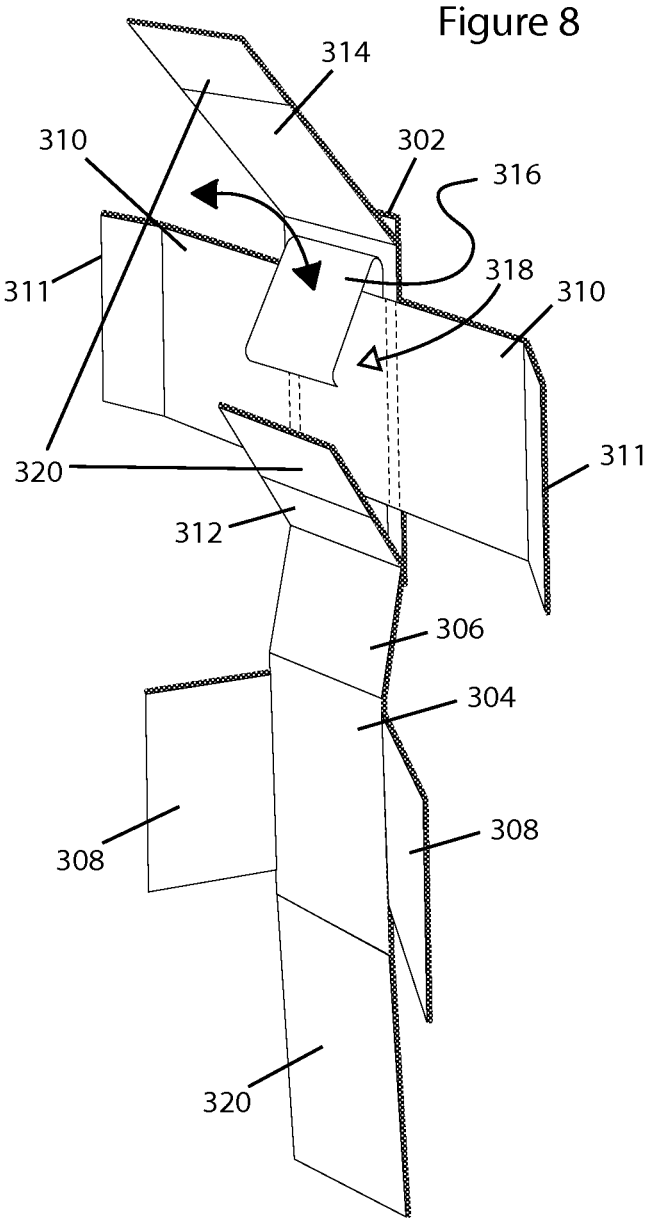
FIG. 8 shows a magazine pouch according to one embodiment in an unassembled configuration.

Referring to FIG. 8, the pouch 300 is shown in an unassembled configuration. The pouch includes an inner panel 302, an outer panel 304, a bottom panel 306, two inner side panels 308 and two outer side panels 310. The pouch 300 further including a first housing panel 312 and a second housing panel 314 to house and maintain a biasing member 316 of a magazine holding mechanism. The biasing member 108 and the biasing member 316 are similar in many respects and can be interchangeably used in any pouch according to the disclosure. The pouch also includes a cover panel 320, the function of which is described in detail below.

All of the above noted panels may be attached to one another by adhesive, welding, stitching and/or any other detachable or permanent attachment method that may be suitable for the materials used to construct each of the panels. For example, if the panels are constructed from fabric, the panels may be sewn together. Alternatively, some or all of the noted panels may be formed as one-piece continuous panels having perforated and/or hinged portions to allow folding and/or movement of one panel relative to another panel. The panels may be constructed from fabric, metal, plastic, mesh, webbing and/or composite materials.

The outer side panels 310 may be defined by a continuous one-piece panel that is attached to the inner panel 302 so as to create a pocket or sleeve 318 for housing the biasing member 316. The biasing member 316 may be constructed from a piece of aluminum, spring steel and/or plastic and bent into the shape as shown in FIG. 8 to provide the function of exerting pressure on to magazines as described herein. The biasing member may be the biasing member 316 shown in FIG. 8 or the biasing member 108 shown in FIG. 1. A portion of the biasing member 316 can be inserted in the sleeve 318 to maintain the biasing member 316 between the outer side panels 310 and the inner panel 302. To secure the biasing member 316, the first housing panel 312 and the second housing panel 314 may be folded over each other and secured by any type of fastener, such as a hook and loop fastener 320. In the example of FIG. 8, the fastener 320 is a Velcro® fastener. The first housing panel 312 and the second housing panel 314 may also function as a cover for the biasing member 316.

Figure 9:
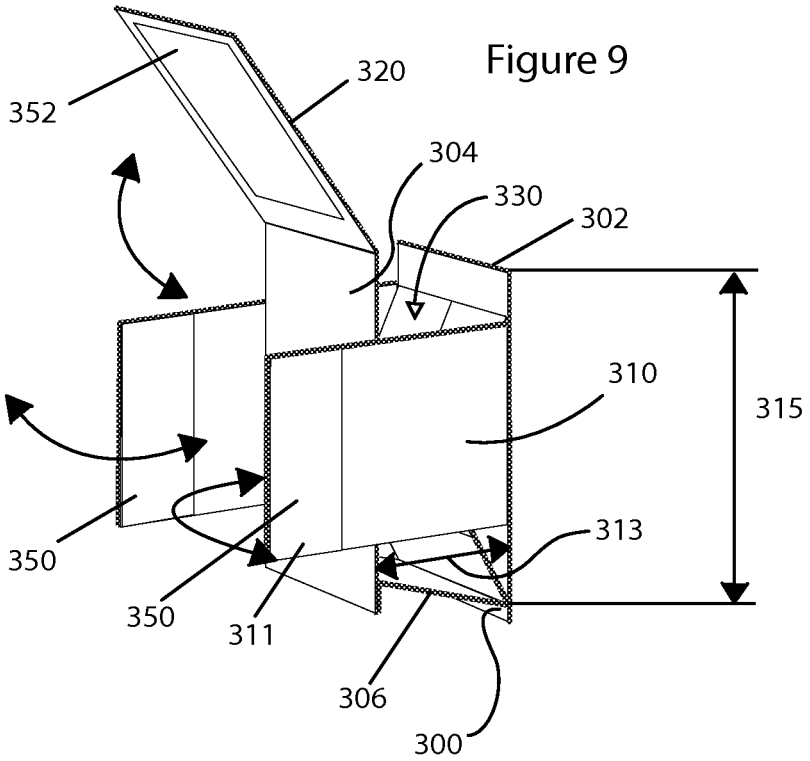
FIGS. 9-11 show the magazine pouch of FIG. 8 being partially assembled.
Figure 10:
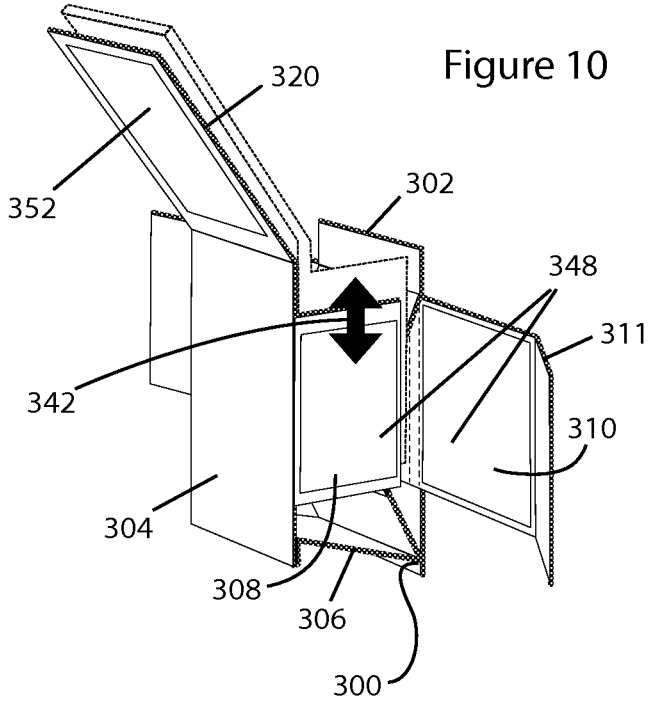
Figure 11:
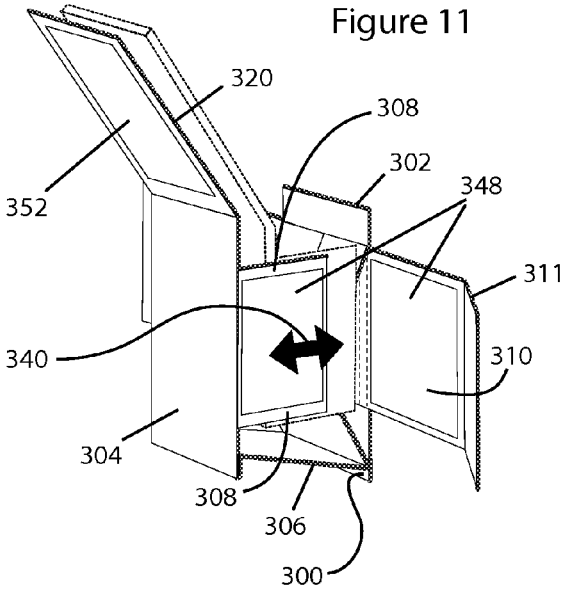

Referring to FIG. 9, to form a cavity 330 in the pouch 300 for holding one or two magazines, the outer panel 304 and the bottom panel 306 may be rotated, pivoted about a hinge and/or folded so that the outer panel 304 is positioned over the first and second housing panels 312 and 314. The inner side panels 308 are then rotated toward the inner panel 302 until the inner side panels 308 are generally parallel to each other as shown in FIGS. 10 and 11. The space between the outer panel 304 and the inner panel 302 defines a width 313 (shown in FIG. 9) of the cavity 330. The inner side panels 308 may define the smallest width 313 of the cavity 330 as shown in FIG. 10, where the inner side panels 308 are shown to be contacting the inner panel 302 either directly or through the outer side panels 310. The configuration shown in FIG. 10 may be used when only a single magazine is stored in the pouch 300. However, the width 313 of the cavity 330 may be adjusted by increasing the space between the outer panel 304 and the inner panel 302. Accordingly, as shown in FIG. 11, the inner side panels 308 may be moved in the direction of the arrow 340 and positioned so as to be spaced apart from the inner panel 302. The configuration shown in FIG. 11 may be used when two magazines are stored in the pouch 300

Adjusting the depth 315 (shown in FIG. 9) of the cavity 330 may be required so that the pouch 300 can accommodate a certain type of magazine. The degree of inclination of the bottom panel 306 may provide the vertical separation between a pair of magazines when placed in the pouch 300. For example the steepest the inclination of the bottom panel 306, the greater the vertical separation between a pair of magazines stored in the pouch 300. The vertical separation between a pair of magazines allows the operator to distinguish the magazines without looking at the pouch and just by touching the pair of magazines. The depth adjustment of the cavity 330 may be performed before, after or simultaneously with the width adjustment described above. To adjust the depth of the pouch 300, the inner side panels 308 are moved up or down in the direction of the arrow 342. Thus, the size of the cavity 330 may be adjusted to accommodate certain types of magazines or a single magazine.

To generally fix the size of the cavity 330 and secure the assembled configuration of the pouch 300, after the width and depth of the cavity 330 are adjusted as described above, the outer side panels 310 are attached to the inner side panels 308 and the outer panel 304 with fasteners, such as hook and loop fasteners 348 (e.g., Velcro®). The outer side panels 310 may also include outer tabs 311 that can wrap around the outside of the outer panel 304 and overlap each other. The outer tabs 311 may be secured together around the cavity 330 and over the outer panel 304 by using one or more fasteners, such as hook and loop fasteners 350 (e.g., Velcro®). To cover and prevent damage to the fasteners 350 (shown in FIG. 9) and to further secure the assembled configuration of the pouch 300, the cover panel 320 is folded or rotated over the overlapping outer tabs 311 and attached to the overlapping outer tabs 311 with fasteners, such as hook and loop fasteners 352 (e.g., Velcro®).

After the pouch 300 is assembled as described above, the pouch 300 may be attached to an operator's belt or other equipment with one or more fasteners that may be provided on the outside of the inner panel 302. If the pouch 300 is configured for storage of a single magazine, the magazine may be inserted into the pouch 300 as shown in FIG. 1. Insertion of the magazine causes the biasing member 316 to compress and exert a force on the magazine. Therefore, the magazine is pushed against the inside surface of the outer panel 304 and frictionally held in the cavity 330. If the pouch 300 is configured for storage of two magazines, a second magazine may be inserted into the pouch 300 as shown in FIG. 4. Insertion of the second magazine causes the biasing member 316 to further compress and exerts a force on both magazines to frictionally hold the magazines in the cavity 330.

Figure 12:
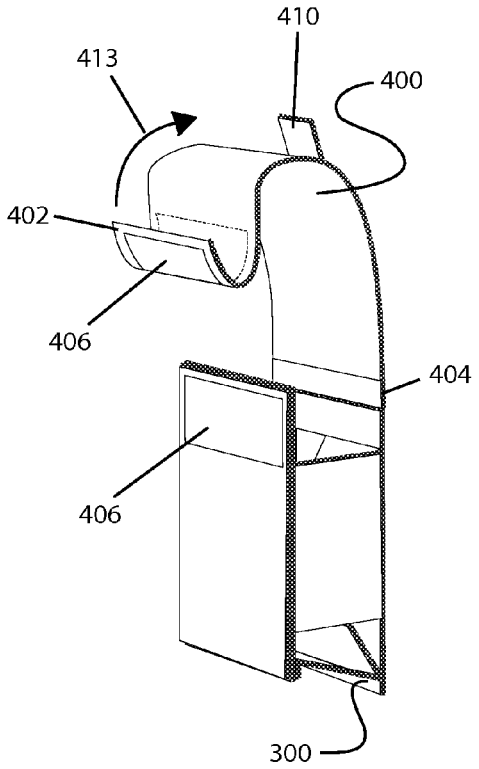
FIGS. 12-14 show a magazine pouch according to one embodiment having a cover.
Figure 13:
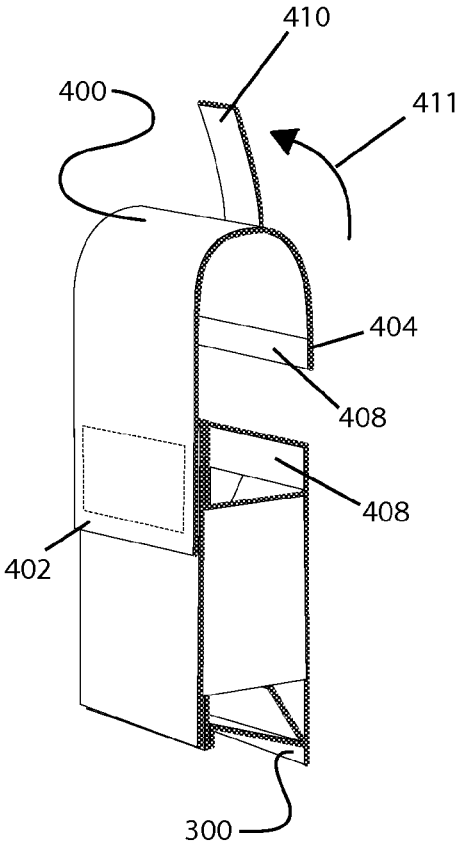
Figure 14:
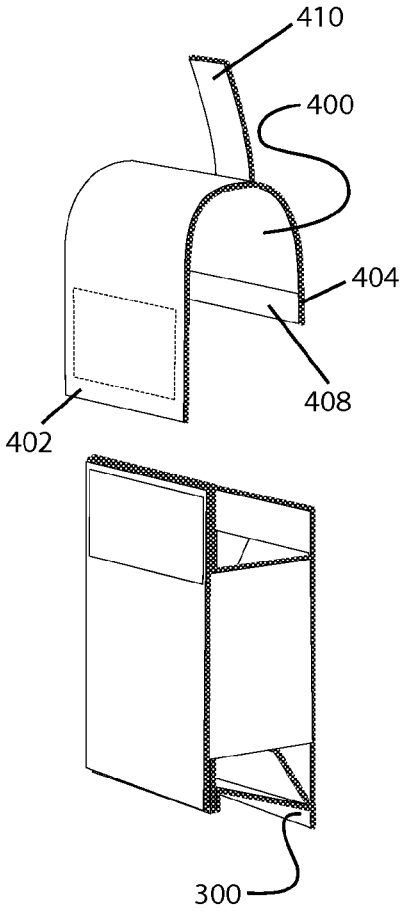

Access to the pouch may be provided by any type of cover that can be placed over the cavity 300. For example, a cover (not shown) may be attached to the inner panel 302 at one end and be removably attachable to the outer panel 304 at the opposite end. Referring to FIGS. 12-14, access to the pouch may be provided by a bi-directional flap 400, which includes an outer end 402 that may be attached to the outside or the inside of the outer panel 304 and an inner end 404 that may be attached to the outside or inside of the inner panel 302. The outer end 402 may be attached to the outside of the outer panel 304 with one or more fasteners, such as a hook and loop fastener 406 (e.g., Velcro®). Similarly, the inner end 404 may be attached to the outside of the inner panel 302 with one or more fasteners, such as a hook and loop fastener 408 (e.g., Velcro®). An operator may open the flap 400 from the first direction 411 shown in FIG. 13, where the inner end 404 is detached from the outside of the inner panel 302. Alternatively, an operator may open the flap 400 from the second direction 413 shown in FIG. 12, where the outer end 402 is detached from the outside of the outer panel 304. The flap 400 may also include a tab 410 to assist an operator in quickly removing the flap 400 from one or both directions. In the example of FIGS. 12-14, the tab 410 is near the inner panel 302. Accordingly, pulling the tab 410 opens the flap from the first direction. Because of the ability of the bias mechanism 108 or 316 to hold the magazines in cavity 300 or 100, respectively, there may be situations where a flap 400 may not be necessary. Thus, the flap 400 may be completely removed as shown in FIG. 14. A bi-directional flap according to the disclosure may be attachable to any inner or outer surfaces of the outer panel 304, inner panel 302 or any parts of a pouch according to the disclosure.

A magazine holder or a magazine pouch as described herein may be constructed from any material such as flexible, pliable, rigid materials or a combination thereof. For example the pouch or any part thereof may be constructed from canvas, any type of fabric, plastic, metal, composite materials or a combination thereof. For example, the pouch may be constructed from canvas. In another example, one or more components of the pouch may include a plastic skeletal plate or structure that is enveloped or covered with a fabric such as canvas. The material of the pouch may be generally fire resistance and/or have a subdued infrared signature. A biasing member as described herein may be constructed from a metal such as spring steel, aluminum, an elastomer, other types of metals or artificial materials, elastic foam, or any type of material that provides the functions of the biasing member as described herein. The biasing member may include an anti-corrosion and or anti-rust coating to provide longevity and proper operation in various environmental conditions.

A fastener as referred to herein may be any type of fastener for detachable or permanent attachment of two parts together. For example a fastener may be a hook and loop fastener such as Velcro®, a strap, a button, a clip, a zipper, snaps, magnetic buttons or snaps, elastic cords, and elastic meshes, stitching, adhesive, welding, soldering, and/or any type of method or device used to detachably or permanently attach two parts together.

Although a particular order of actions is described above, these actions may be performed in other temporal sequences. For example, two or more actions described above may be performed sequentially, concurrently, or simultaneously. Alternatively, two or more actions may be performed in reversed order. Further, one or more actions described above may not be performed at all. The apparatus, methods, and articles of manufacture described herein are not limited in this regard.

While the invention has been described in connection with various aspects, it will be understood that the invention is capable of further modifications. The above described embodiments are exemplary and this application is intended to cover any variations, uses or adaptation of the invention following, in general, the principles of the invention, and including such departures from the present disclosure as come within the known and customary practice within the art to which the invention pertains.

What is claimed is:

1. A magazine holder for use with a gun comprising:

a cavity configured to receive a first magazine and a second magazine, the cavity comprising a first cavity portion having a width configured to receive the first magazine or the second magazine and a second cavity portion adjacent the first cavity portion and having a width configured to receive the first magazine or the second magazine;

a biasing member in the cavity and configured to engage at least one of the first magazine or the second magazines located in the cavity to maintain the at least one of the first magazine or second magazine in the cavity, the biasing member being movable between a first position, a second position and a third position, wherein:

in the first position, the cavity is without any magazines and a first portion of the biasing member is in the first cavity portion and a second portion of the biasing member is in the second cavity portion;

in the second position, the first magazine is in the first cavity portion and the first portion of the biasing member is substantially in the second cavity portion and engages the first magazine to maintain the first magazine in the cavity; and in the third position, the first magazine is in the first cavity portion and the second magazine is in the second cavity portion and the first portion of the biasing member is in the second cavity portion and engages the second magazine to maintain the first magazine and the second magazine in the cavity.

2. The magazine holder of claim 1, wherein the biasing member is removable from the interior cavity and is configured for use in a cavity of another magazine holder or another storage device for holding magazines.

3. The magazine holder of claim 1, further comprising a pair of spaced apart walls at least partly defining the cavity, wherein the biasing mechanism is connected to one of the walls and applies force onto the second magazine to maintain the first and the second magazines between the biasing mechanism and the other wall.

4. The magazine holder of claim 1, further comprising a bottom wall opposite to an opening of the cavity, wherein the bottom wall is inclined to position the first and second magazines received in the cavity vertically spaced relative to each other.

5. The magazine holder of claim 1, wherein the biasing member comprises a receiving portion facing the first magazine when the first magazine is being inserted into the cavity, and wherein the receiving portion of the biasing member is inclined relative to a direction of insertion of the at least one magazine into the cavity.

6. The magazine holder of claim 1, wherein the interior walls of the cavity at least partially comprise a friction enhancing coating.

7. The magazine holder of claim 1, further comprising a cover configured to cover an opening of the cavity, the cover having a first end being detachably attachable to a first wall partially defining the cavity and a second end being detachably attachable to a second wall partially defining the cavity and being opposite to the first wall, wherein the cavity is accessible by any one or a combination of detaching the first end from the first wall, detaching the second end from the second wall, or detaching both the first end from the first wall and the second end from the second wall.

8. The magazine holder of claim 1, wherein a size of the cavity is adjustable.

9. A magazine holder for use with a gun comprising:

a first wall, a second wall opposite the first wall, a bottom wall and a pair of opposing side walls defining a cavity configured to receive a first magazine and a second magazine, a distance between the first wall and the second wall defining a width of the cavity;

a biasing member connected to the first wall and extending in the cavity more than half of the width toward the second wall in a first position of the biasing member;

wherein when only the first magazine is in the cavity, the biasing member is compressed to a second position and pushes the first magazine against the second wall to maintain the first magazine in the cavity;

wherein the second magazine is insertable into the cavity between the first magazine and the biasing member such that when the second magazine is in the cavity and the biasing member is further compressed to a third position, the biasing member pushes the second magazine toward the second wall and the second magazine pushes the first magazine against the second wall to maintain the first magazine and the second magazine in the cavity; and wherein the bottom wall is upwardly inclined from the first wall to the second wall to position the first magazine vertically higher than the second magazine when the first magazine and the second magazine are inside the cavity;

wherein when the first magazine is pulled out of the cavity, the second magazine is pushed by the biasing member along the bottom wall toward the second wall and against the second wall to reposition the second magazine inside the cavity at a higher vertical position.

10. The magazine holder of claim 9, wherein the biasing member is removable from the cavity and is configured for use in a cavity of another magazine holder or another storage device for holding magazines.

11. The magazine holder of claim 9, wherein the biasing member comprises a receiving portion facing an opening of the cavity, and wherein the receiving portion of the biasing member is inclined relative to a direction of insertion of magazines into the cavity.

12. The magazine holder of claim 9, wherein interior walls of the cavity at least partially comprise a friction enhancing coating.

13. The magazine holder of claim 9, further comprising a cover configured to cover an opening of the cavity, the cover having a first end being detachably attachable to the second wall and a second end being detachably attachable to the first wall, wherein the cavity is accessible by any one or a combination of detaching the first end from the second wall, detaching the second end from the first wall, or detaching both the first end from the second wall and the second end from the first wall.

14. The magazine holder of claim 9, wherein a distance between the second wall and the first wall is adjustable to adjust the width of the cavity and wherein a vertical position of the second wall relative to the first wall is adjustable to adjust a depth of the cavity.

15. A magazine holder for use with a gun comprising:

a first wall;

a second wall opposite the first wall, a distance between the first wall and the second wall defining a width;

a pair of side walls extending between the second wall and the first wall;

a bottom wall extending between the second wall and the first wall;

a biasing member connected to the first wall and extending from the first wall to the second wall more than half of the width;

wherein the first wall, the second wall, the side walls and the bottom wall define an cavity;

wherein the bottom wall is inclined relative to the second wall and the first wall such as to vertically stagger at least two magazines placed in the cavity; and wherein when two magazines are in the cavity, the magazine engaging the second wall is positioned vertically higher than the magazine engaging the biasing member;

wherein when two magazines are in the cavity and the magazine engaging the second wall is removed from the cavity, the biasing member pushes the remaining magazine to the location of the removed magazine; and wherein when one magazine is in the cavity, another magazine is insertable between the magazine in the cavity and the biasing member.

16. The magazine holder of claim 15, wherein the biasing member is removable from the cavity and is configured for use in a cavity of another magazine holder or another storage device for holding magazines.

17. The magazine holder of claim 15, wherein the biasing member comprises a receiving portion facing an opening of the cavity, and wherein the receiving portion of the biasing member is inclined relative to a direction of insertion of magazines into the cavity.

18. The magazine holder of claim 15, wherein interior walls of the cavity at least partially comprise a friction enhancing coating.

19. The magazine holder of claim 15, further comprising a cover configured to cover an opening of the cavity, the cover having a first end being detachably attachable to a second wall and a second end being detachably attachable to the first wall, wherein the cavity is accessible by any one or a combination of detaching the first end from the second wall, detaching the second end from the first wall, or detaching both the first end from the second wall and the second end from the first wall.

20. The magazine holder of claim 15, wherein the first wall, the second wall, the side walls and the bottom wall are configured to be disassembled into a planar part and assembled back together to form the cavity.

21. The magazine holder of claim 15, wherein the biasing member comprises a rounded portion configured to contact any of the two magazines for slidable insertion and removal of any of the two magazines into the cavity.

* * * * *